US005452886A

United States Patent [19]

Cote et al.

[11] Patent Number: 5,452,886

[45] Date of Patent: Sep. 26, 1995

[54] DEVICE FOR SLOWING DOWN SIGNATURES IN A FOLDING MACHINE

[75] Inventors: Kevin L. Cote, Durham, N.H.; Richard D. Curley, North Reading, Mass.

[73] Assignee: Heidelberger Druckmaschinen AG, Heidelberg, Germany

[21] Appl. No.: 103,842

[22] Filed: Aug. 9, 1993

[51] Int. Cl.[6] ..... B65H 5/34

[52] U.S. Cl. ..... 271/270; 271/187; 271/82

[58] Field of Search ..... 271/275, 277, 271/270, 203, 204, 202, 272, 66, 70, 72, 187, 82, 83; 101/246, 409

[56] References Cited

U.S. PATENT DOCUMENTS

| | | | |
|---|---|---|---|
| 3,884,461 | 5/1975 | Hauser | 101/409 |
| 4,132,403 | 1/1979 | Weisbach et al. | 271/82 |
| 4,290,595 | 9/1981 | Thunker | 271/82 |
| 4,434,979 | 3/1984 | Kobler et al. . | |
| 4,629,175 | 12/1986 | Fischer et al. | 271/202 |
| 4,767,112 | 8/1988 | Köbler | 270/54 |
| 4,901,996 | 2/1990 | Schlough | 271/187 |
| 5,141,221 | 8/1992 | Mack et al. | 271/277 |
| 5,277,413 | 1/1994 | Boss | 271/187 |

*Primary Examiner*—H. Grant Skaggs
*Attorney, Agent, or Firm*—Kenyon & Kenyon

[57] ABSTRACT

A device for slowing down signatures being transported in a folding machine is provided. The device provides a plurality of rotary grippers which positively grip signatures exiting a tape conveyor system in the folding machine traveling at a high velocity. A deceleration drum is also provided for slowing down the signatures through a smooth velocity profile. The deceleration drum has a plurality of pivot arms pivotally mounted on a pivot disc rotating about a first axis, the pivot arms being connected to a control disc by a control link, the control disc rotating about a second axis parallel to, and offset from, the first axis. The rotary grippers are attached to outward ends of the pivot arms. The rotary grippers grip the leading edges of the signatures as they exit the tape conveyor system while the trailing edges are still being controlled by the tape conveyor device. The deceleration drum may alternatively be constructed of a cam and linkage system in place of the pivot arm/pivot disc and control link/control disc mechanism.

6 Claims, 12 Drawing Sheets

DEVICE FOR SLOWING DOWN SIGNATURES IN A FOLDING MACHINE

FIELD OF THE INVENTION

The present invention relates generally to a device for slowing down printed products and more particularly to a device for decelerating signatures in a folding machine through a smooth velocity profile.

BACKGROUND OF THE INVENTION

Fan wheels are commonly used devices for slowing down signatures in a folding machine. Fan wheels comprise a plurality of fan wheel discs defined by a plurality of outwardly projecting curve-shaped fan blades. Fan wheel pockets formed by adjacent blades receive signatures exiting a folding device. The curve shape and jagged surface of the fan blades slow the forward movement of the signatures being deposited in the fan pockets to a complete stop. Once a given fan pocket receiving a signature has turned through approximately 90° the signature is deposited on a delivery system.

A drawback of devices of this nature is that because the signatures enter the fan wheel pockets at such high velocities they are thrust tumultuously against the blades of the fan wheel causing the signatures to tear and otherwise become damaged. Another drawback of these devices is that it is not possible to precisely aim the products towards the bottoms of the fan wheel pockets.

The reason for this is that as the signatures come off belts leading to the fan wheel, a number of factors come into play, such as the paper caliper, the number of pages in the signature, the nature of the paper and even the amount of ink thereon, which will all affect the motion of the signature so that, dependent on the cumulative effect of such factors the signature may land neatly on the bottom of the fan wheel pocket or may recoil backwards or catch on the edge of a fan wheel blade. Once a signature is irregularly positioned on the fan wheel, it will be deposited onto the delivery belt irregularly as well and the product stream thereon is likely to contain laterally displaced, unevenly spaced or skewed signatures. This is especially true where large speed reductions, e.g., (5:1) are required.

U.S. Pat. No. 4,629,175 discloses an apparatus intended to overcome some of these drawbacks. The apparatus comprises a number of rows of grippers rotating between a transfer or supply device and a delivery system. The grippers are slowed down by an acceleration/deceleration drive running in the direction of motion from the transport or supply device to the delivery system from approximately the supply speed to approximately the speed of the delivery system and are able to be accelerated up to the speed they were moving at before such deceleration in the following section of their motion. The grippers are mounted to a cylindrical drum rotating at a constant speed, and the rows of grippers decelerated and accelerated by the deceleration/acceleration drive are turned at a speed equal to that of the drum and are mounted so that they may be shifted in relation to the outer face of the drum.

However, a drawback with this device is that the transfer of the signature from the supply device to the deceleration drum can cause distortion misalignment and/or tearing of the signature. Because this transfer is achieved by positioning the deceleration drum so that the gripper rotates into a position in front of the leading edge of the signature being delivered by the supply device, the velocity of the signature being controlled by the supply device must be greater than the tangential velocity of the gripper on the deceleration drum. This causes the signature to gain on the gripper until it has entered the throat of the gripper a desired distance. The gripper then closes and the velocity of the leading edge of the product abruptly changes to match the velocity of the gripper. If the trailing edge of the signature is in the control of the supply device at this time, then distortion of the signature will occur and possible tearing. A further drawback of this device is that it is not capable of achieving high speed reduction ratios as are now required to accommodate today's new high speed printing presses. This device is designed for speed reduction ratios of approximately 3:1. Speed reduction ratios of 5:1 are now being demanded.

OBJECTS AND SUMMARY OF THE INVENTION

It is an object of the present invention to provide a device for continuously handling a signature as it exits a folding device in a printing press and is transported to a delivery system for further processing.

It is another object of the present invention to provide a device for decelerating consecutive signatures along the same velocity curve.

It is a further object of the present invention to provide a device for delivering consecutive signatures from a folding device to a delivery system in an orderly fashion with minimal distortion, misalignment or damage to the products.

It is still another object of the present invention to provide a device for delivering consecutive signatures from a folding device to a delivery system in a shingled format where the pitch between consecutive signatures is precisely maintained.

The present invention provides a device for slowing down signatures being transported in a folding machine, comprising: means for positively gripping a leading edge of a signature exiting a transporting device in the folding machine traveling at a high velocity; and a deceleration drum for slowing down the signature through a smooth velocity profile, the deceleration drum having at least one pivot arm pivotally mounted on a pivot disc rotating about a first axis, the at least one pivot arm being connected to a control disc by a control link, the control disc rotating about a second axis parallel to, and offset from, the first axis, the gripping means being attached to an outward end of the at least one pivot arm. The gripping means preferably grips the leading edge of the signature as it exits the transporting device while the trailing edge is still being controlled by the transporting device.

The transporting device may be a cutting cylinder, folding cylinder, tape conveying system or other delivery system. The gripping means may be a gripper head or preferably a rotary gripper defined by a set of oppositely rotating upper and lower rollers which receive the leading edge of the signature exiting the transporting device at a nip formed between the upper and lower rollers. The rotary gripper prevents abrupt changes in the velocity of the signature as it is transferred from the transporting device to the slow down device, and hence minimizes distortion, misalignment and possible tearing of the signature during the slow down process. The deceleration drum may alternatively comprise a cam and linkage system in place of the pivot arm/pivot disc and control link/control disc mechanism.

An advantage of the present invention is that since the deceleration device continuously handles the signatures until they are ready for deposit on the delivery system, the product stream is unlikely to contain laterally displaced, unevenly spaced or skewed signatures.

Another advantage of the present invention is that since the transporting device does not use friction to slow down the signatures they are less likely to be damaged.

A further advantage of the present invention is that since consecutive signatures follow the same velocity curve the pitch never varies.

A still further advantage of the present invention is that it can obtain speed reduction ratios on the order of 5:1.

Other objects, characteristics and advantages of the present invention will become apparent in view of the detailed description along with the accompanying drawings that follow.

DETAILED DESCRIPTION

Figure 1:
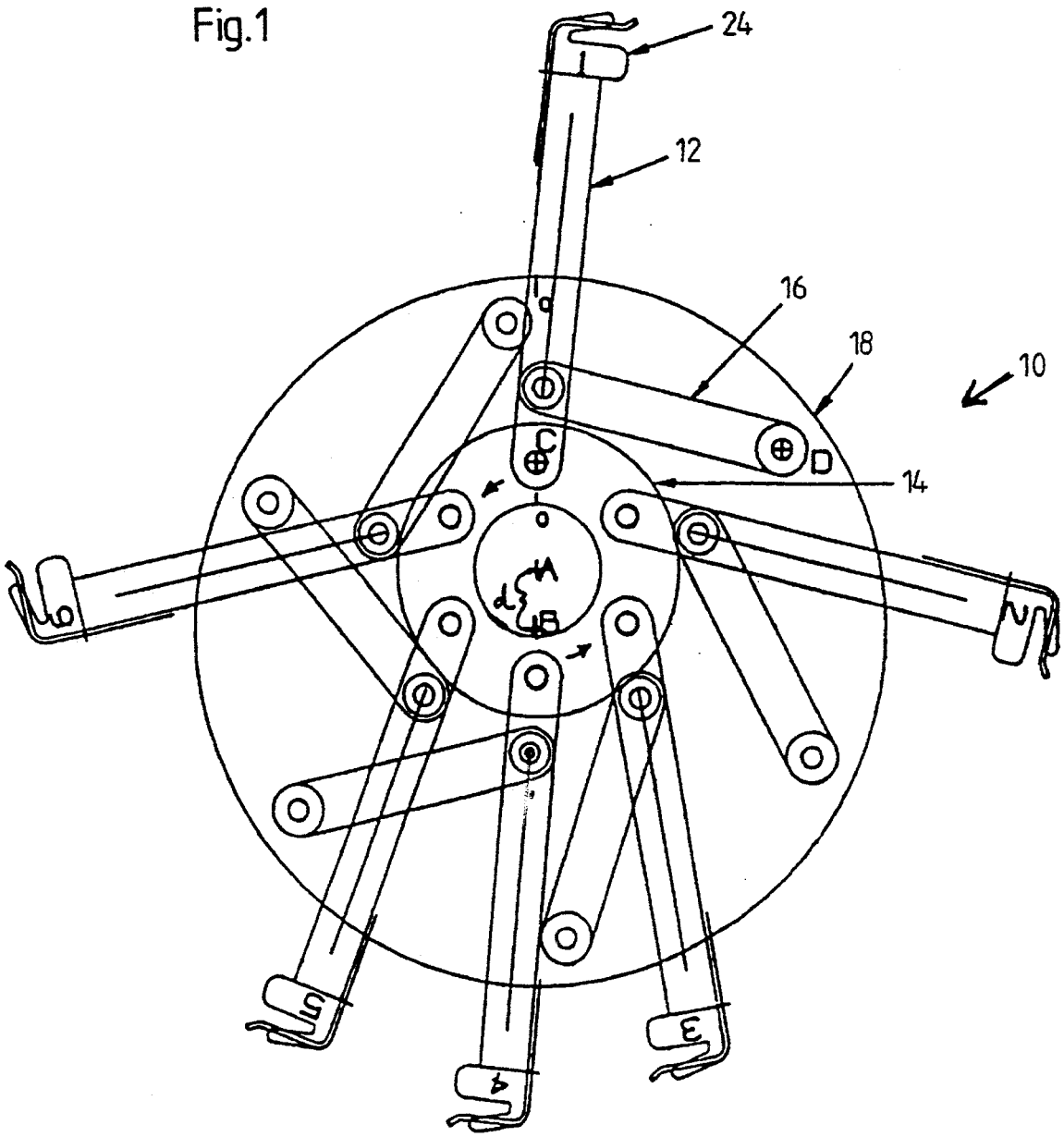
FIG. 1 is a schematic diagram of one embodiment of a deceleration drum for slowing down signatures in a folding machine according to the present invention.

Referring to FIG. 1 a deceleration drum according to the present invention for slowing down signatures in a folding machine is shown generally by reference number 10. The drum 10 comprises a plurality of pivot arms 12 which are connected to a rotating pivot disc 14 and allowed to pivot independently of each other. The connection points of the pivot arms 12 to the pivot disc 14 form a base circle concentric about the center of the pivot disc (point A). A control link 16 is connected to each pivot arm 12 at a point radially outward from the pivot point of the pivot arm. The opposite end of each of the control links 16 is connected to a rotating control disc 18. The connection points of the control links 16 to the control disc 18 form a base circle concentric about the center of the control disc (point B).

The pivot disc 14 and the control disc 18 rotate about their own centers at the same speed and in the same direction. The centers of the pivot disc 14 and the control disc 18 are fixed and offset from each other, by a distance d, that is the distance between points A and B, as shown in FIG. 1. The greater the offset of the centers, the larger the speed reduction of the pivot arms 12.

Figure 2:
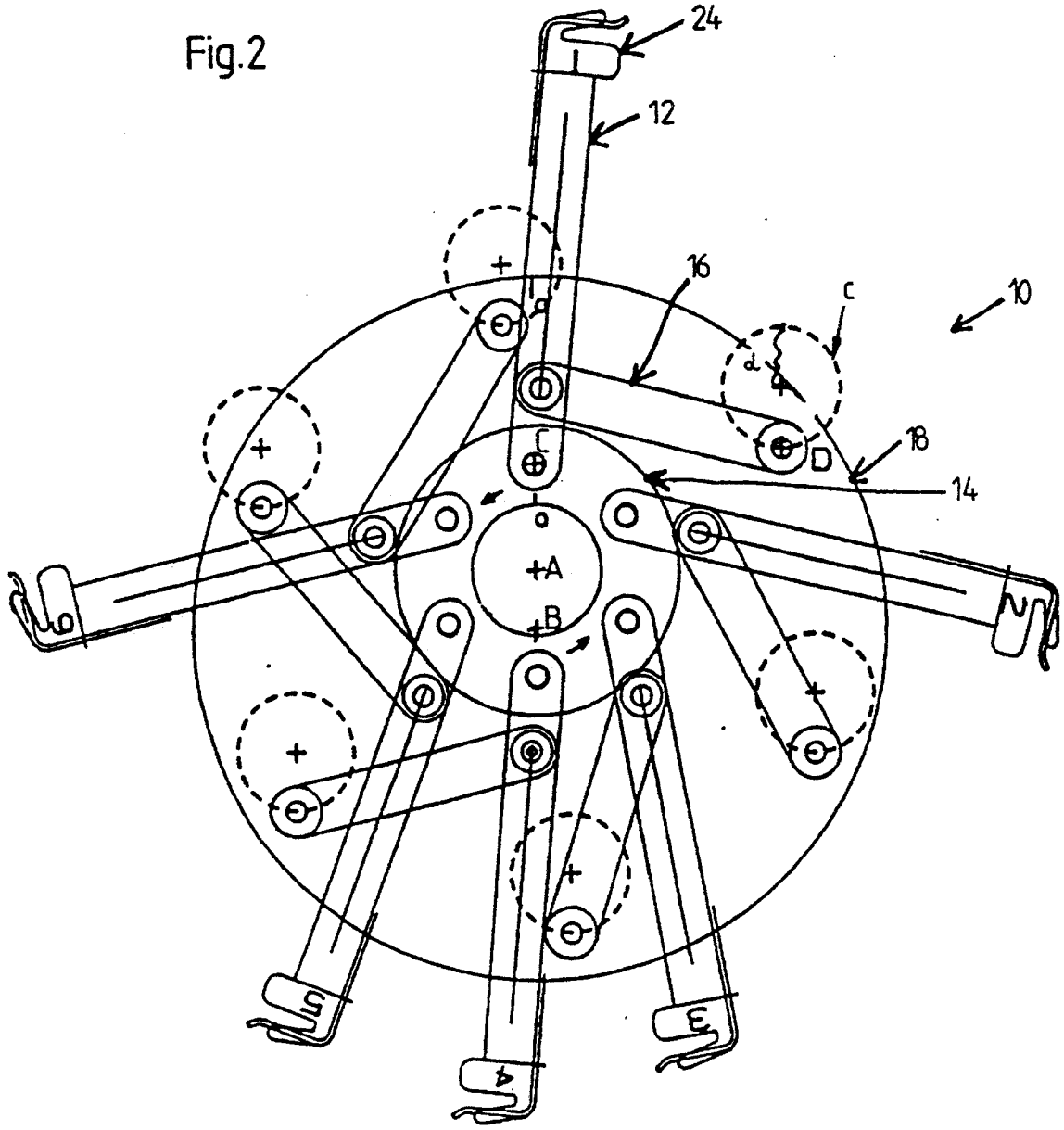
FIG. 2 is a schematic diagram of the deceleration drum shown in FIG. 1 showing the path of a point D where a control link attaches to a control disc as it moves relative to a point C where a pivot arm attaches to a pivot disc.

As the two discs 14, 18 rotate, the point at which the control link 16 attaches to the control disc 18 (point D) moves relative to the point at which the pivot arm 12 attaches to the pivot disc 14 (point C). The path of point D relative to point C is a circle c whose radius is equal to the offset distance d between the center of the pivot disc 14 and the center of the control disc 18, as shown in FIG. 2. This circular path exists for each pivot arm 12/control link 16 pair. Therefore, there exist a number of parallel circles equal to the number of pivot arm 12/control link 16 pairs. These parallel circles are positioned equidistant on a base circle about the center of pivot disc 14 and at a radius that is a function of the control link 16 length and control disc 18 size.

The deceleration drum 10 accepts signatures directly from a cutting cylinder, tape system or other transporting device at high speeds. The signatures are positively gripped and decelerated through a smooth velocity profile. Each signature is shingled and delivered from the drum 10 at a slow speed. The exact pitch of each shingled signature is a function of the pitch of the signature entering the drum 10 and the speed reduction ratio of the drum. To obtain optimum registration and control of the delivered signature product, a positive, gripped to gripper, transfer to a single copy gripper conveyor can be used. Performance of belt delivery, stack or log making, or other conventional systems will be improved due to the improved quality of the product registration delivered from the deceleration drum 10.

Figure 3:
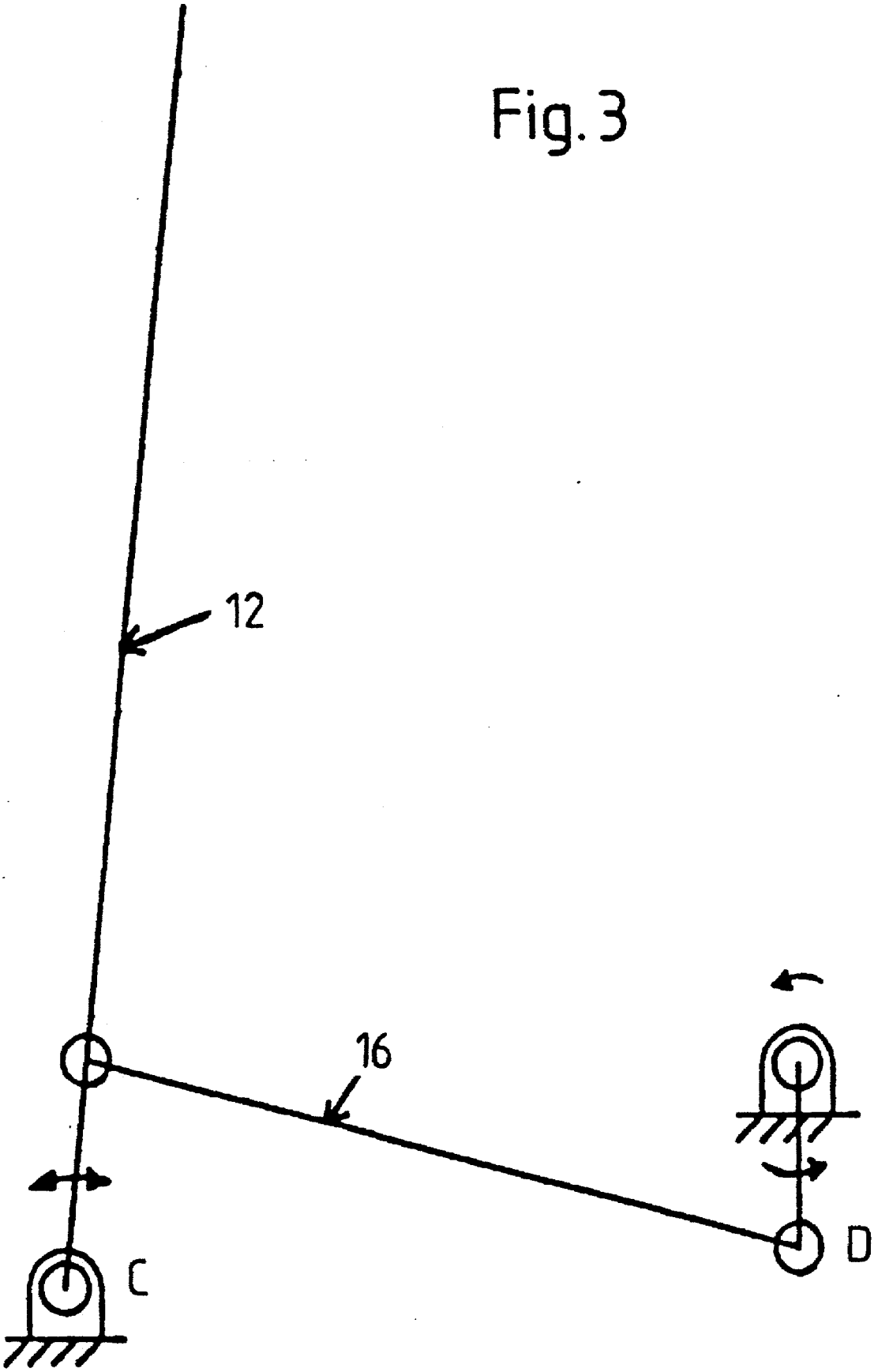
FIG. 3 is a geometric representation of the pivot arm/control link pair shown in FIGS. 1 and 2 illustrated as a stationary four bar linkage.
Figure 4:
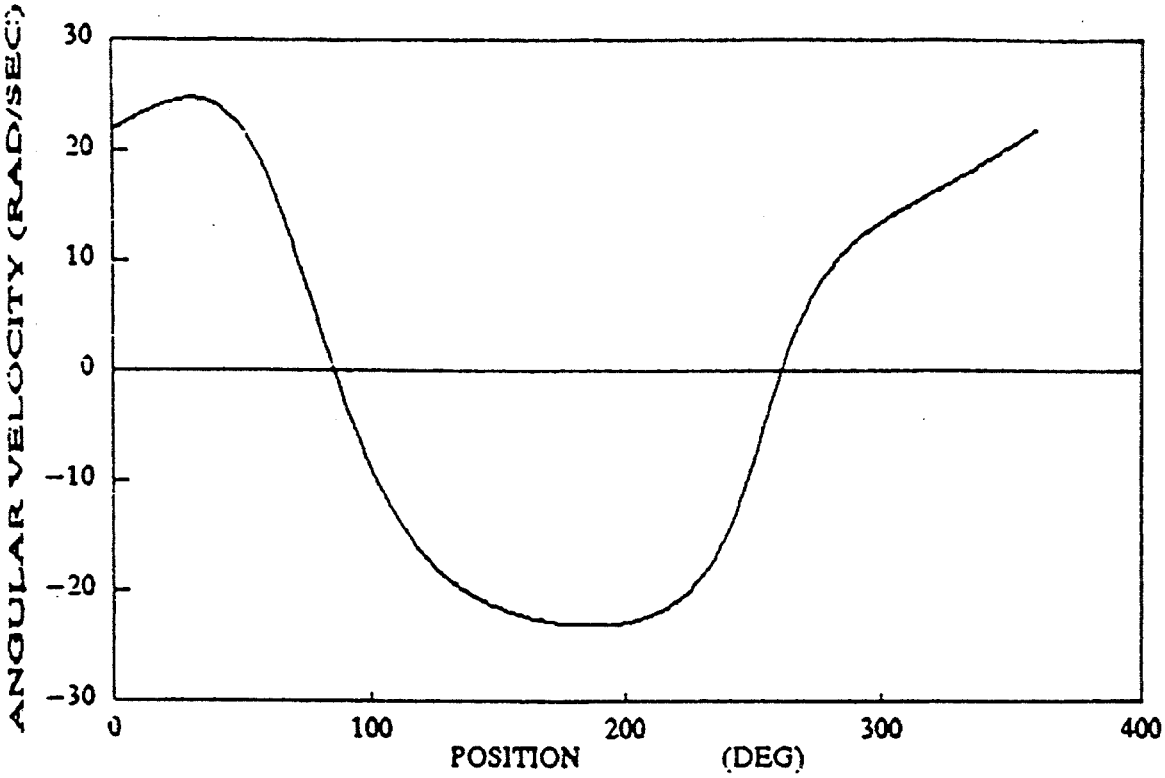
FIG. 4 is a graph of the angular velocity (in rad/sec) of the pivot arm as a function of the position (in degrees) of the pivot disc shown in FIGS. 1 and 2.
Figure 5:
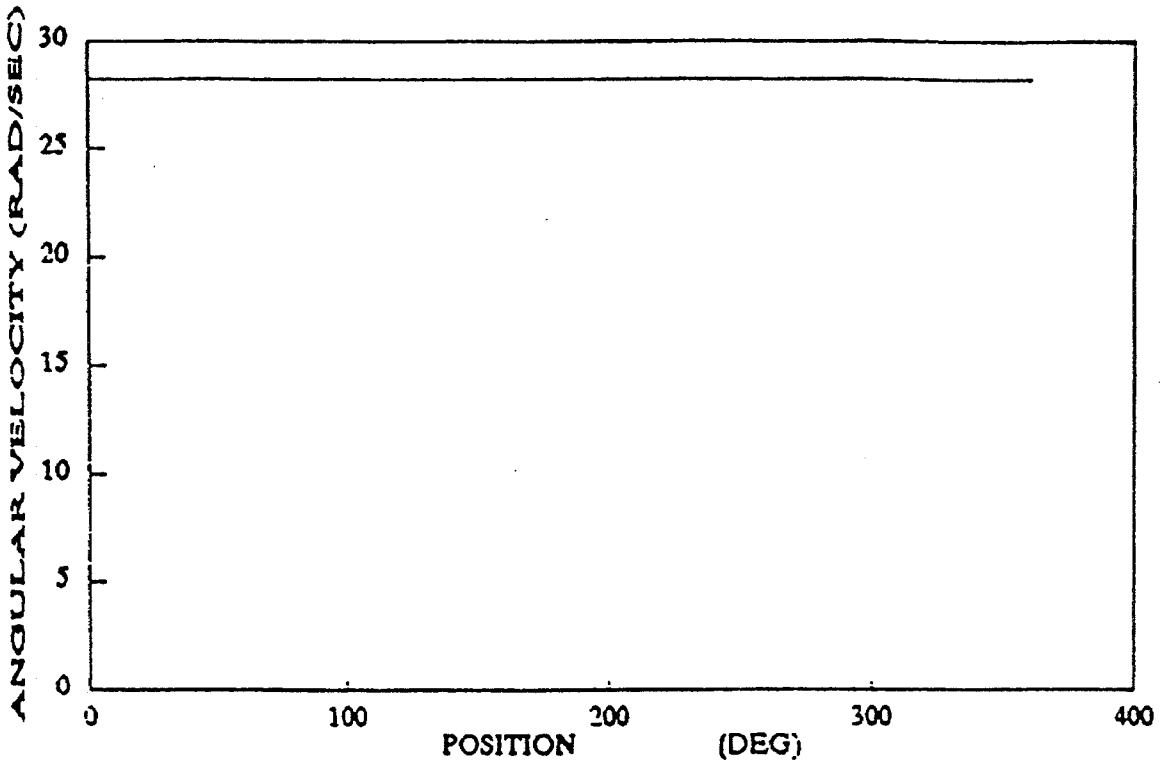
FIG. 5 is a graph of the angular velocity (in rad/sec) of the pivot disc as a function of the position (in degrees) of the control disc shown in FIGS. 1 and 2.
Figure 6:
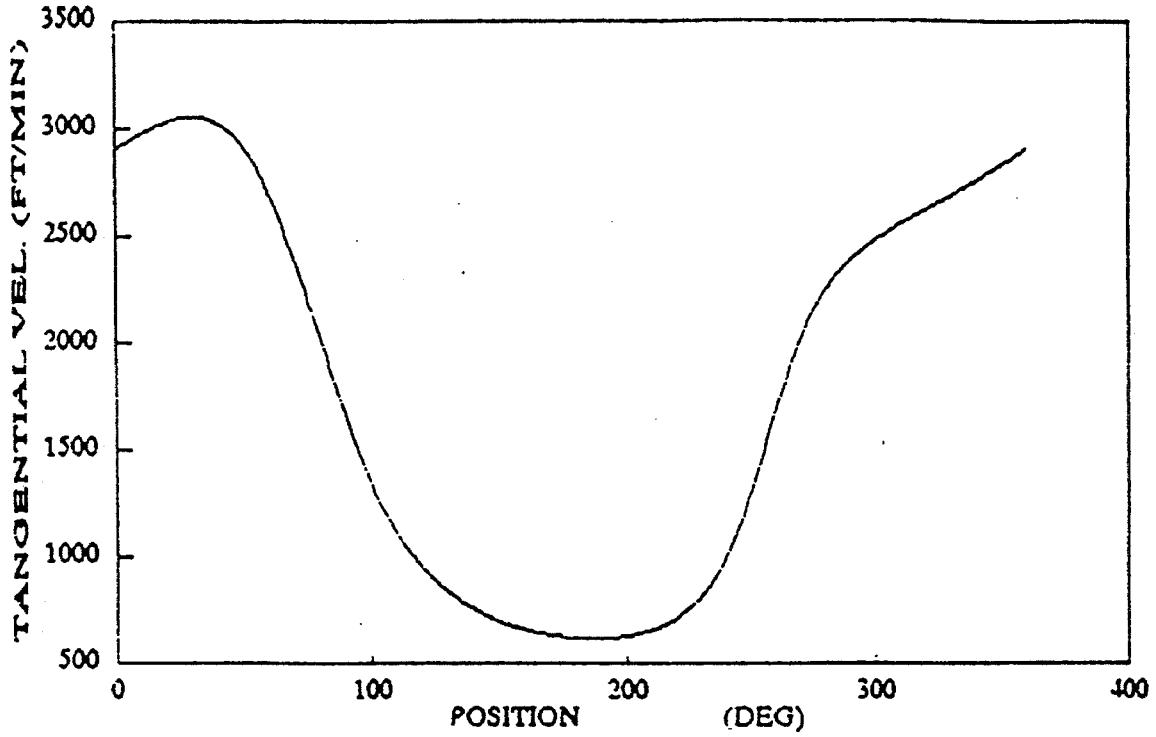
FIG. 6 is a graph of the tangential velocity (in ft/min) of the pivot arm as a function of the position (in degrees) of the deceleration drum shown in FIGS. 1 and 2.
Figure 7:
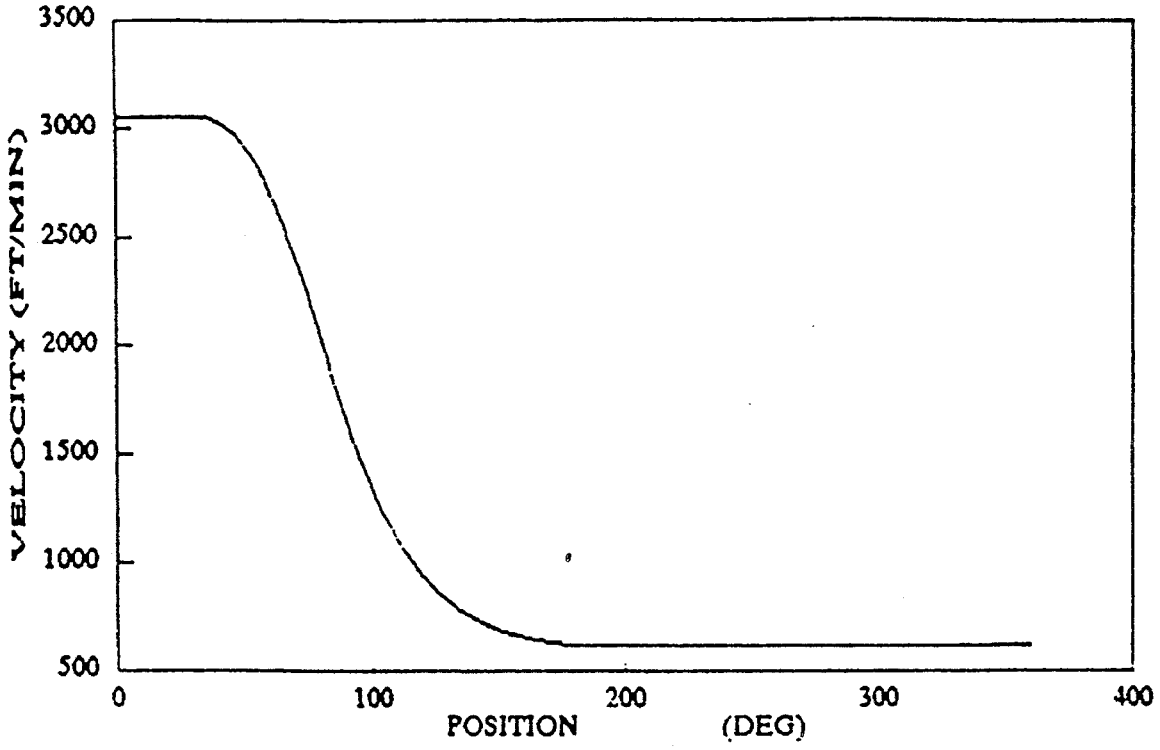
FIG. 7 is a graph of the velocity (in ft/min) of a signature as a function of the position (in degrees) of the deceleration drum shown in FIGS. 1 and 2.

To achieve a desired velocity profile, the pivot arm 12/control link 16 geometry can be modeled as a stationary four bar linkage, as shown in FIG. 3. First, the pivot arm's 12 angular velocity relative to the position of the pivot disc 14 is analyzed using the four bar linkage model. A graph of this velocity profile is shown in FIG. 4. Once this velocity is determined, the tangential velocity of the end of the pivot arm 12 due to the rotation of the pivot disc 14 can be easily calculated. Next, the tangential velocity of the pivot arm 12 due to the angular rotation of the pivot disc 14 about the control disc 18 is calculated. A graph of the angular velocity of the pivot disc 14 about the control disc 18 is shown in FIG. 5. The two tangential velocities are then superimposed and the result of the superposition is the true tangential velocity of the pivot arm 12. A graph of this composite velocity is shown in FIG. 6. The geometry is preferably set so that the maximum tangential velocity of the pivot arm 12 is essentially matched to the signature velocity entering the deceleration drum 10 and the minimum tangential velocity of the pivot arm is essentially matched to the velocity of the delivery system receiving signatures from the drum. FIG. 7 shows a typical signature velocity profile according to the present invention.

Figure 8:
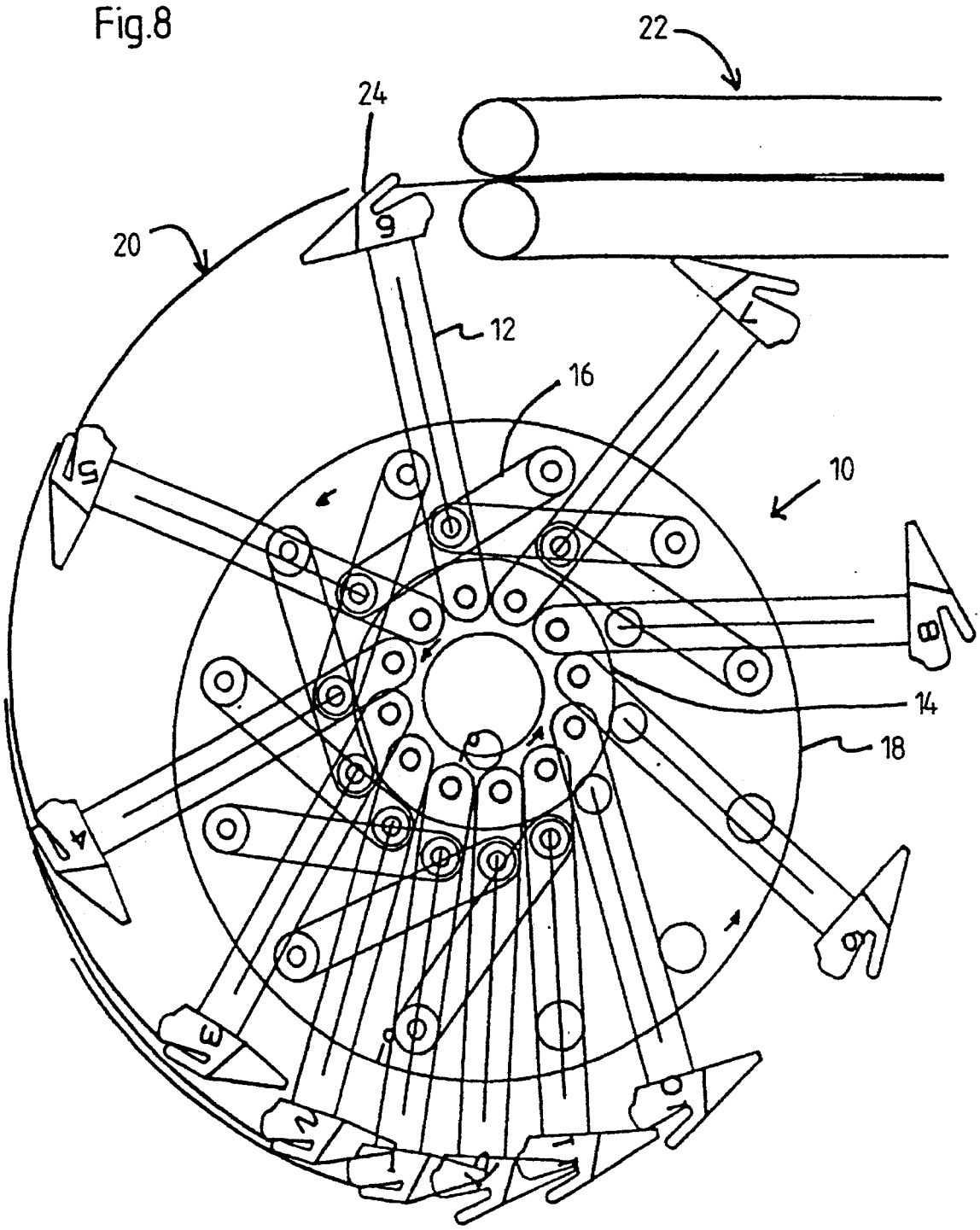
FIG. 8 is a schematic diagram showing a signature being gripped by a gripper head according to the present invention as the signature exists a tape conveyor system.

Signatures 20 exiting a tape conveyor system 22 are gripped by a gripper head 24 attached at the outward end of each pivot arm 12, as shown in FIG. 8. The gripper head 24 grips the signature 20 as it enters the deceleration drum 10. The gripper head 24 is brought in to position to grip the leading edge of an incoming signature 20 and then begins to decelerate the signature. A cam (not shown) is used to control the timing of the gripper system. The system is preferably timed so that the leading edge of the incoming signature 20 is gripped by the gripper head 24 before the trailing edge of the signature is released by the tape conveyor system 22.

As the signature 20 decelerates in the drum 10, its pitch relative to an adjacent signature decreases until an overlapping shingle is induced. The shape of the gripper head 24 is wedged in the direction of travel so that the gripper head will push a previous signature outward and allow for the initiation of a shingle, as shown in FIG. 8. The pitch of adjacent signatures in the deceleration drum 10 decreases until the signatures reach the delivery velocity when they are then released. The signature 20 is then taken away from the drum 10 by a delivery system (not shown).

Figure 9:
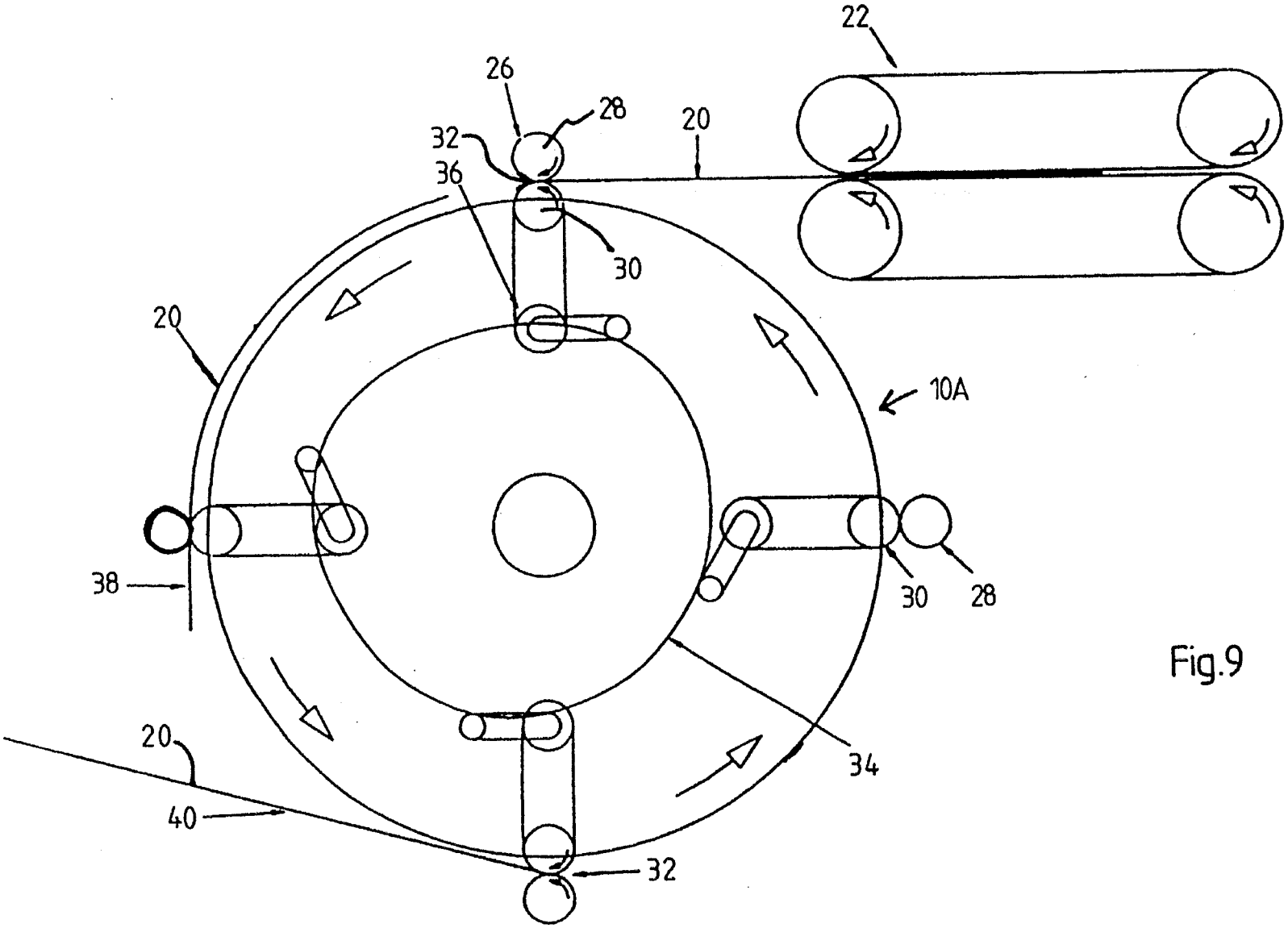
FIG. 9 is a schematic diagram of another embodiment of a deceleration drum and a rotary gripper system according to the present invention.

In an alternate embodiment of the present invention, a rotary gripper 26 defined by a set of oppositely rotating upper and lower rollers 28, 30 is used to control the signature 20 on a deceleration drum 10A in place of the gripper head 20, as shown in FIG. 9. A nip 32 between the upper and lower rollers 28, 30 is the grip point for an incoming signature. The rotation of the upper and lower rollers 28, 30 about their respective axes is controlled by a cam or linkage system. The tangential velocity of the surface of the upper and lower rollers 28, 30 as they rotate about their respective axes is superimposed upon the tangential velocity of the nip 32 about the center of the decelerating drum 10A. The result of this superposition is a velocity that is essentially equal to the velocity of the signature 20 exiting the tape conveyor 22. This velocity match allows for the leading edge of the signature 20 to be controlled by the set of upper and lower rollers 28, 30 at the same time as the trailing edge of the signature is controlled by the tape conveyor system 22 without any distortion of the signature.

The nip 32 is positioned in the path of the signature just as the gripper head 24 is positioned. The rotary gripper 26 has the advantage of controlling the signature 20 from the instant that the leading edge of the signature 20 reaches the nip point 32. There is no need to wait for the signature 20 to enter a gripper throat defined by an opening between the oppositely rotary upper and lower rollers 28, 30 of the rotary gripper 26 before the deceleration drum 10A takes control of the signature. The leading edge of the signature 20 is driven into the in-running nip 32 the desired distance before the rotation of the upper and lower rollers 28, 30 about their respective axes stops. The upper and lower rollers 28, 30 follow a fixed velocity curve so that the signature 20 decelerates smoothly from its velocity exiting the tape system 22 to the velocity of the deceleration drum 10A.

To release the signature 20 from the rotary gripper 26, the upper and lower rollers 28, 30 are rotated about their respective axes in a direction opposite to the direction in which they receive the signature from the tape system 22. The tangential velocity of the surface of the upper and lower rollers 28, 30 as they rotate about their respective axes is subtracted from the tangential velocity of the nip 32 rotating about the center of the deceleration drum 10A to yield an additional deceleration of the signature 20. By controlling the rotational velocity of the upper and lower rollers 28, 30 at the delivery point, the velocity of the signature 20 can be made to match the velocity of the delivery system for a smooth transfer.

FIG. 9 shows a signature 20 entering the in-running nip 32 of the rotating gripper 26. A cam 34 and linkage 36 are shown as one means of controlling the velocity of the rotary gripper 26 to achieve a velocity match with the signature 20 in control of the tape conveyor system 22. The pivot arm 12/control link 16 and pivot disc 14/control disc 18 mechanism described above and shown in FIGS. 1, 2 and 8 is an another means of controlling the velocity of the rotary gripper 26. The reference numeral 38 shows the signature 20 after the rotation of the upper and lower roller 28, 30 has stopped with the desired amount of the signature 20 driven past the nip 32. The reference numeral 40 shows the signature 20 as it is just being released by the outrunning nip 32 of the rotary gripper 26. FIG. 9 shows one possible embodiment of the rotary gripper 26. In this embodiment the deceleration drum 10A provides mounting for four sets of upper and lower rollers 28, 30 with a cam controlled linkage system 34, 36 controlling the velocity of the upper and lower rollers 28, 30. As noted above, other arrangements may be provided for controlling the velocity of the upper and lower rollers 28, 30.

Figure 10:
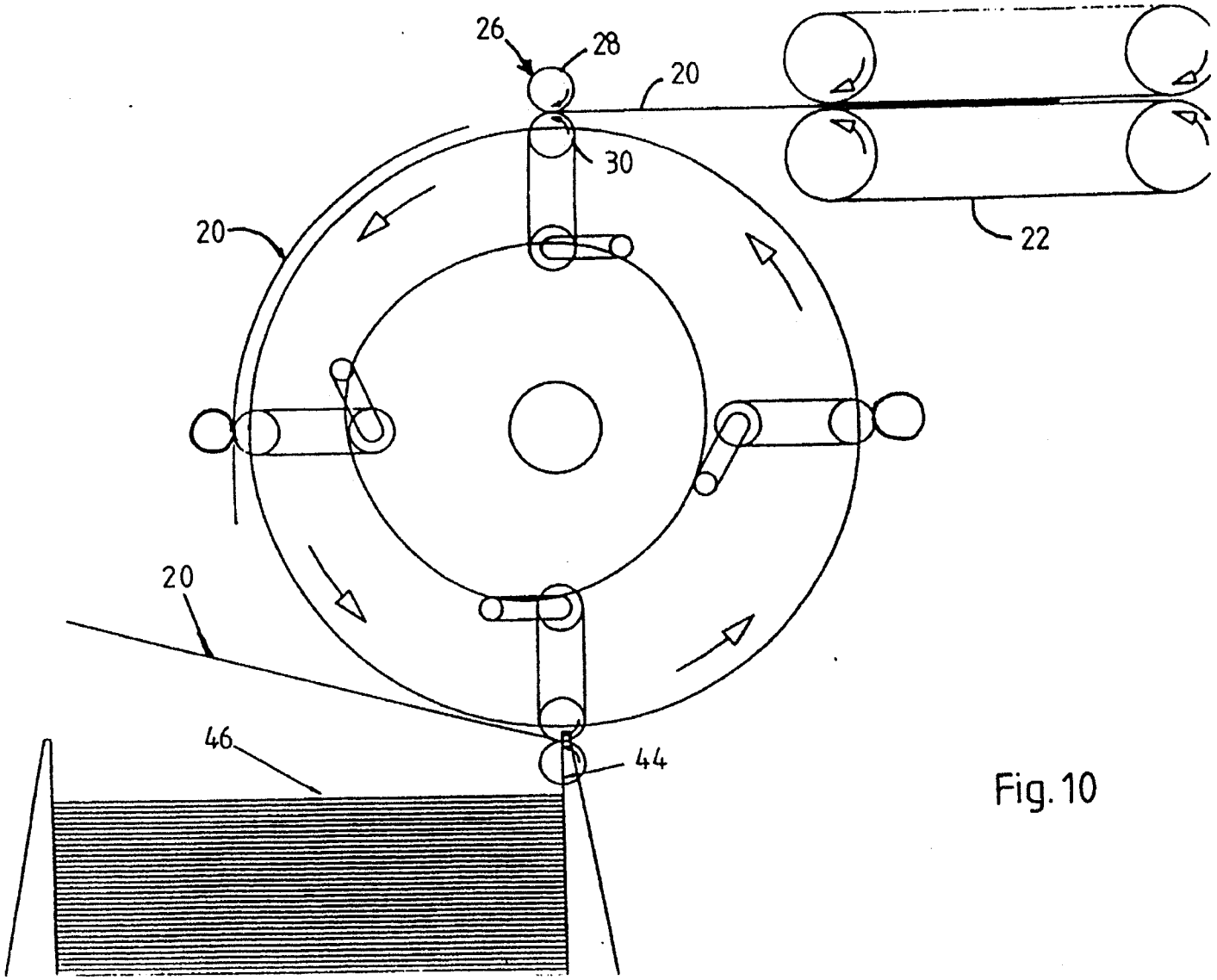
FIG. 10 is a schematic diagram of the deceleration drum/rotary gripper system shown in FIG. 9 illustrating delivery of the signatures in a single stack mode.

FIG. 10 shows one possible delivery mode where the tangential velocity of the signature 20 as it is released from the rotary gripper 26 approaches zero. The signature 20 is registered against a fixed member 44. Damage to the signature 20 due to impact against the registration member is minimized because of its near zero tangential velocity. The signatures 20 settle vertically along the registration member 44 and form a vertical stack 46.

Figure 11:
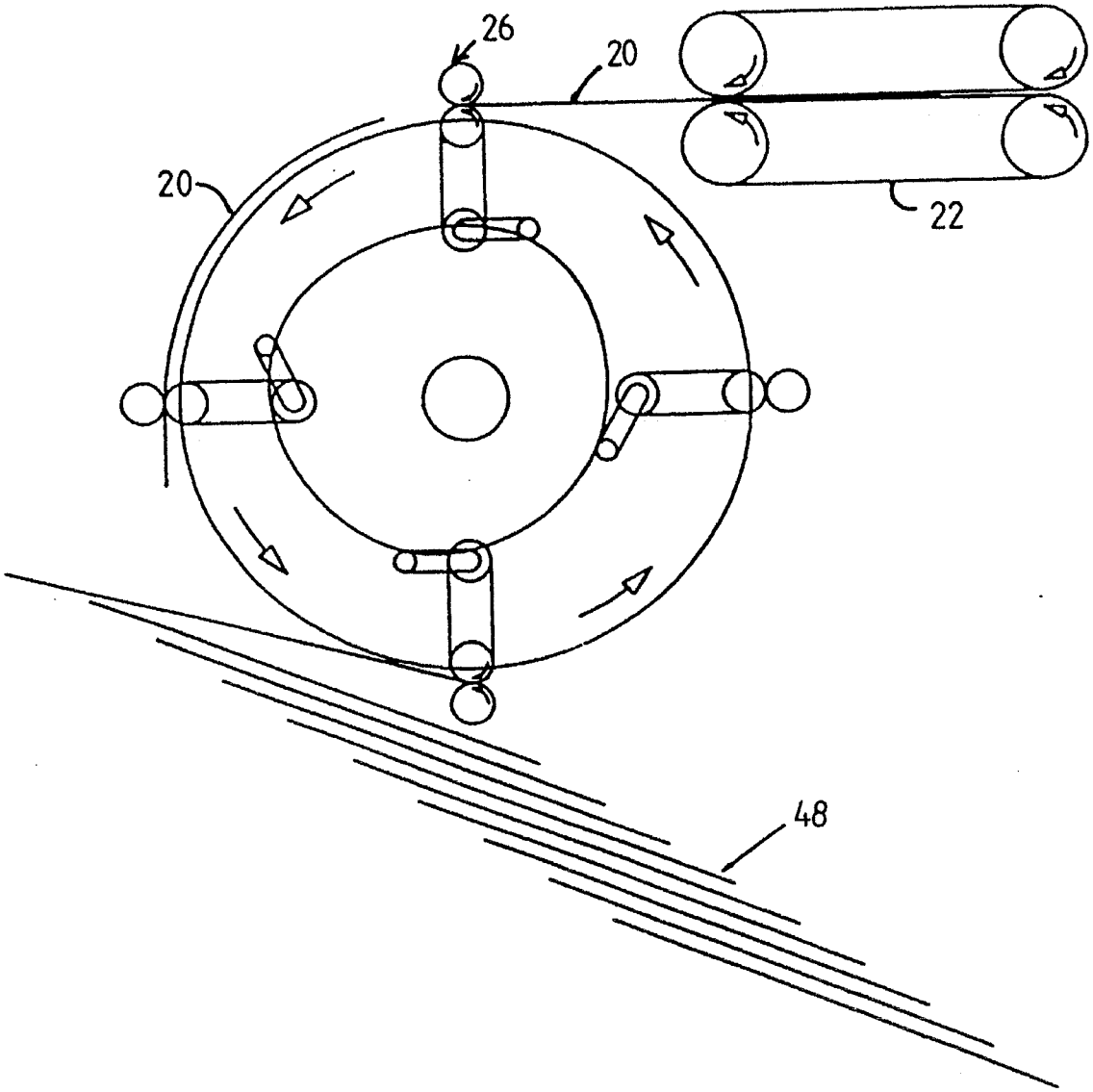
FIG. 11 is a schematic diagram of the deceleration drum/rotary gripper system shown in FIG. 9 illustrating delivery of the signatures in a shingled format.

FIG. 11 shows another possible delivery mode where the tangential velocity of the signature 20 as it is released from the rotary gripper 26 matches the speed of a tangential delivery system 48, e.g., a single copy gripper conveyor or a delivery belt system.

Figure 12:
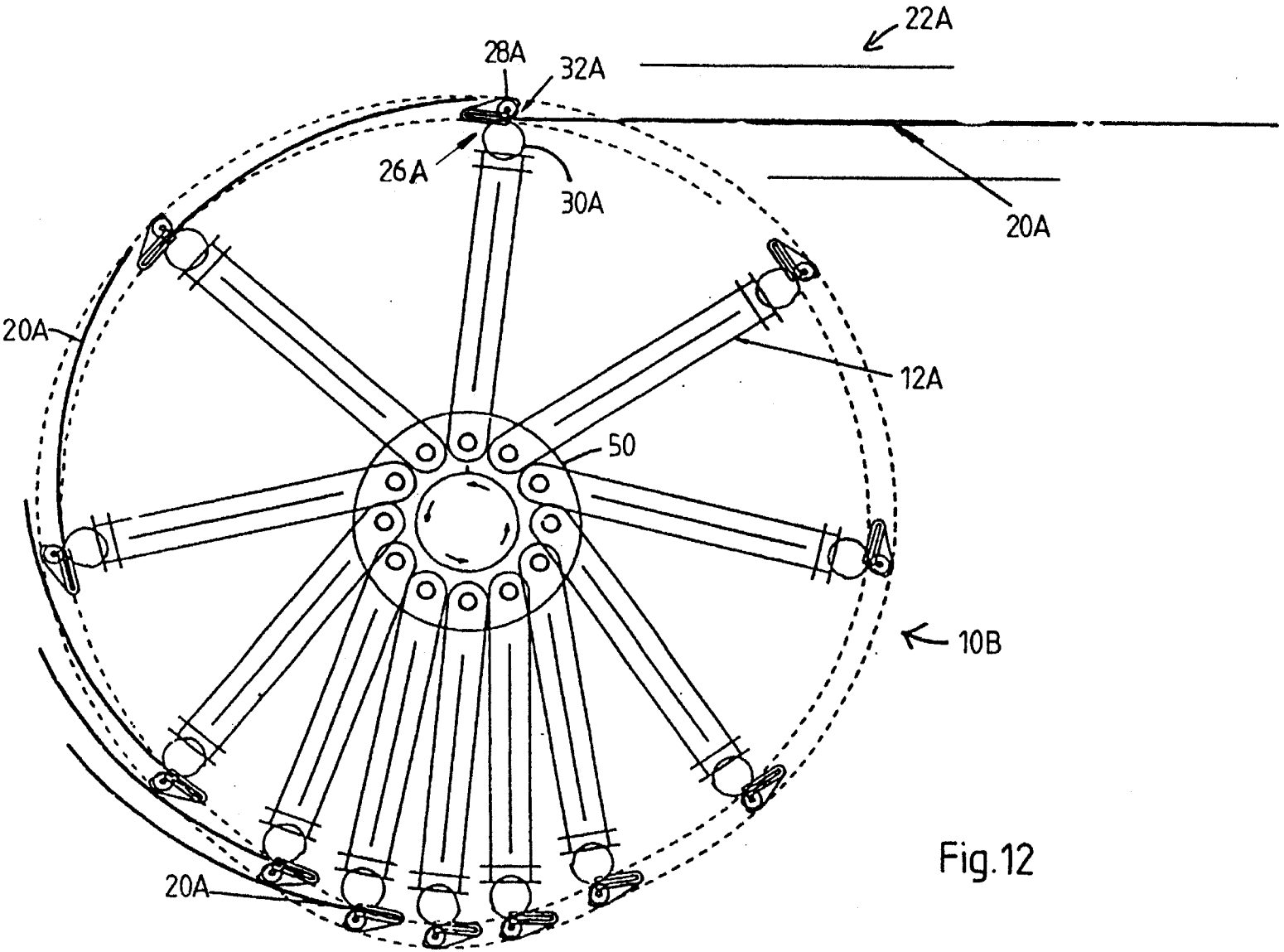
FIG. 12 is a schematic diagram of another embodiment of a deceleration drum/rotary gripper system according to the present invention.

FIG. 12 shows a further embodiment of the rotary gripper 26A defined by oppositely rotating upper and lower rollers 28A, 30A mounted on an outward end of a pivot arm 12A that rotates into position in front of a signature 20A being released by a tape conveyor 22A. The pivot arm 12A is mounted at its inward end to a rotating disc 50 which is driven by a known acceleration/deceleration device, such as the one disclosed in U.S. Pat. No. 4,629,175. In this embodiment, the tangential velocity of the nip point 32A about the center of the deceleration drum 10B is not constant. The tangential velocity of the surface of the upper and lower rollers 28A, 30A as they rotate about their respective centers is superimposed upon the tangential velocity of the nip point 32A. The result of this superposition is a constant velocity that matches the velocity of the signature 20A exiting the tape conveyor 22A. The upper and lower rollers 28A, 30A rotate in reverse to release the signature 20A in a shingled fashion.

While the present invention is capable of various modifications and alternative constructions, it is not intended to limit the invention to the specific embodiments disclosed herein. Rather, it is intended to cover all modifications within the spirit and scope of the invention as expressed in the claims.

We claim:

1. A device for slowing down signatures being transported in a folding machine, comprising:

means for positively gripping a leading edge of a signature exiting a transporting device in the folding machine traveling at a high velocity; and a deceleration drum for slowing down the signature through a smooth velocity profile, the deceleration drum having at least one pivot arm pivotally mounted on a pivot disc rotating about a first axis, the at least one pivot arm being connected to a control disc by a control link, the control disc rotating about a second axis parallel to, and offset from, the first axis, the gripping means being attached to an outward end of the at least one pivot arm.

2. The slow down device according to claim 1, wherein the gripping means is a gripping head.

3. The slow down device according to claim 2, wherein a plurality of gripping heads are attached to an associated plurality of pivot arms.

4. The slow down device according to claim 1, wherein the transporting device is a cutting cylinder.

5. The slow down device according to claim 1, wherein the transporting device is a folding cylinder.

6. The slow down device according to claim 1, wherein the transporting device is a tape conveyor system.

* * * * *